US011795679B2

(12) United States Patent
Douglass

(10) Patent No.: US 11,795,679 B2
(45) Date of Patent: Oct. 24, 2023

(54) ASYMMETRIC LEACHING CHAMBER FOR ONSITE WASTEWATER MANAGEMENT SYSTEM

(71) Applicant: Prinsco, Inc., Willmar, MN (US)

(72) Inventor: Brian L. Douglass, Willmar, MN (US)

(73) Assignee: Prinsco, Inc., Willmar, MN (US)

( * ) Notice: Subject to any disclaimer, the term of this patent is extended or adjusted under 35 U.S.C. 154(b) by 0 days.

(21) Appl. No.: 17/812,621

(22) Filed: Jul. 14, 2022

(65) Prior Publication Data

US 2023/0012614 A1 Jan. 19, 2023

Related U.S. Application Data

(60) Provisional application No. 63/310,771, filed on Feb. 16, 2022, provisional application No. 63/223,230, filed on Jul. 19, 2021.

(51) Int. Cl.
*E03F 1/00* (2006.01)

(52) U.S. Cl.
CPC ..... *E03F 1/003* (2013.01)

(58) Field of Classification Search
CPC ..... E03F 1/002; E02F 1/003; E02B 11/00; E02B 11/005; E02B 13/00
See application file for complete search history.

(56) References Cited

U.S. PATENT DOCUMENTS 2,153,789 A 4/1939 Carswell et al.
3,495,410 A 2/1970 Bailey et al.
3,648,468 A 3/1972 Bowers
4,245,924 A 1/1981 Fouss et al.
4,254,885 A 3/1981 Fouss et al.
4,286,808 A 9/1981 Fouss et al.
4,357,190 A 11/1982 Fouss et al.
4,359,167 A 11/1982 Fouss et al.
4,360,042 A 11/1982 Fouss et al.
4,363,732 A 12/1982 Crates et al.
4,374,079 A 2/1983 Fouss et al.
4,523,613 A 6/1985 Fouss et al.
4,527,319 A 7/1985 Rosenbaum et al.
RE32,312 E 12/1986 Crates et al.
4,709,723 A 12/1987 Sidaway et al.
4,759,661 A 7/1988 Nichols et al.
5,017,041 A 5/1991 Nichols
5,087,151 A 2/1992 DiTullio
5,156,488 A 10/1992 Nichols
5,336,017 A 8/1994 Nichols
5,401,116 A 3/1995 Nichols
(Continued)

*Primary Examiner* — Benjamin F Fiorello

(74) *Attorney, Agent, or Firm* — Schroeder & Siegfried, P.A.

(57) ABSTRACT

A wastewater leaching chamber having asymmetric corrugations running transversely along the length of the chamber, where each transverse corrugation has a wide section on one side and a narrow section on the opposed side of the chamber, such that the corrugation walls run at an angle to the longitudinal axis of the chamber. The widest corrugation side of the chamber has a large straight sidewall, and the corrugation forms an arch which curve across and downward from the top of the straight sidewall to the narrow side of the corrugation at the opposing base of the chamber. The asymmetric arch is comprised of a multi radius curve from the top of the straight side to the opposing base footer.

20 Claims, 11 Drawing Sheets

(56) References Cited

U.S. PATENT DOCUMENTS 5,401,459 A 3/1995 Nichols et al.
5,419,838 A 5/1995 DiTullio
5,441,363 A * 8/1995 Gray ..... E03F 1/003 138/173
5,498,104 A * 3/1996 Gray ..... E03F 1/003 403/364
5,511,903 A 4/1996 Nichols et al.
5,556,231 A 9/1996 Sidaway et al.
5,588,778 A 12/1996 Nichols et al.
5,669,733 A 9/1997 Daly et al.
5,716,163 A 2/1998 Nichols et al.
5,773,756 A 6/1998 DiTullio
5,839,844 A 11/1998 Nichols et al.
D403,047 S 12/1998 Gray
5,890,838 A 4/1999 Moore, Jr. et al.
6,018,909 A 2/2000 Potts
6,076,993 A 6/2000 Gray
6,129,482 A 10/2000 DiTullio
6,270,287 B1 8/2001 Gray
6,322,288 B1 11/2001 DiTullio
6,375,388 B1 4/2002 Zoeller et al.
6,443,652 B1 9/2002 Houch et al.
6,485,647 B1 11/2002 Potts
D474,524 S 5/2003 Benecke
D474,525 S 5/2003 Benecke
D477,381 S 7/2003 Benecke
6,592,293 B1 7/2003 Hedstrom et al.
6,602,023 B2 8/2003 Crescenzi et al.
6,612,777 B2 9/2003 Maestro
6,679,653 B1 1/2004 DiTullio
6,680,011 B2 1/2004 Moore, Jr. et al.
6,698,975 B1 3/2004 Benecke
6,719,490 B2 4/2004 Maestro
6,783,683 B2 8/2004 Collings
6,814,863 B2 11/2004 Hallahan et al.
6,854,925 B2 2/2005 DiTullio
6,887,383 B2 5/2005 Potts
6,907,997 B2 6/2005 Thacker et al.
6,923,905 B2 8/2005 Potts
6,969,464 B1 11/2005 Potts
6,991,734 B1 1/2006 Smith et al.
6,994,355 B2 2/2006 Brochu et al.
7,004,221 B2 2/2006 Moore, Jr. et al.
7,008,138 B2 3/2006 Burnes et al.
7,033,496 B2 4/2006 Thacker et al.
7,052,209 B1 5/2006 Kruger et al.
7,118,306 B2 10/2006 Kruger et al.
7,160,059 B2 1/2007 Hedstrom et al.
D537,912 S 3/2007 Benecke
D538,387 S 3/2007 Benecke
D538,388 S 3/2007 Benecke
D538,882 S 3/2007 Benecke
7,189,027 B2 3/2007 Brochu et al.
7,207,747 B1 4/2007 Englad
7,217,063 B2 5/2007 Moore, Jr. et al.
7,226,241 B2 6/2007 DiTullio
7,237,981 B1 7/2007 Vitarelli
7,273,330 B1 9/2007 Brochu et al.
7,306,399 B1 12/2007 Smith
7,306,400 B1 12/2007 Brochu et al.
7,309,434 B2 12/2007 Potts
7,311,467 B2 12/2007 Moore, Jr.
7,351,005 B2 4/2008 Potts
7,351,006 B2 4/2008 Burnes et al.
7,364,384 B1 4/2008 Swistak
7,374,670 B2 5/2008 Potts
7,396,188 B2 7/2008 Brochu et al.
7,413,382 B2 8/2008 Hedstrom et al.
7,419,331 B2 9/2008 Brochu et al.
7,419,332 B1 9/2008 Brochu et al.
7,451,784 B2 11/2008 Goddard
7,465,122 B2 12/2008 Brochu et al.
7,465,390 B2 12/2008 Potts
7,473,053 B1 1/2009 Brochu et al.
7,491,015 B2 2/2009 Coppes et al.
7,500,805 B1 3/2009 Brochu et al.
7,517,172 B2 4/2009 Sipaila
7,585,130 B2 9/2009 Swistak et al.
7,611,306 B1 11/2009 Hallahan et al.
7,632,447 B2 12/2009 Swistak et al.
7,637,691 B1 12/2009 DiTullio
D613,819 S 4/2010 DiTullio
7,744,759 B1 6/2010 Potts
7,806,627 B2 10/2010 DiTullio
7,841,801 B2 11/2010 Burnes
D630,294 S 1/2011 Hardesty et al.
7,887,256 B2 2/2011 Miskovich
7,914,230 B2 3/2011 Moore, Jr. et al.
7,914,231 B2 3/2011 Coppes et al.
D638,094 S 5/2011 DiTullio
D638,095 S 5/2011 DiTullio
8,002,497 B2 8/2011 Hedstrom et al.
8,070,005 B1 12/2011 Kruger et al.
8,147,688 B2 4/2012 Adams et al.
8,151,999 B1 4/2012 Moore, Jr. et al.
8,256,990 B2 9/2012 Koerner
D668,318 S 10/2012 DiTullio
8,297,880 B2 10/2012 Brochu et al.
8,322,948 B2 12/2012 Moore, Jr. et al.
8,337,119 B2 12/2012 Burnes et al.
8,366,346 B2 2/2013 DiTullio
8,414,222 B2 4/2013 DiTullio
8,425,147 B2 4/2013 Cislo et al.
8,425,148 B2 4/2013 DiTullio
8,491,224 B2 7/2013 Cobb et al.
8,550,807 B2 10/2013 Kolbet
8,579,624 B2 11/2013 Sutton et al.
8,617,390 B2 12/2013 Potts
8,672,583 B1 3/2014 Mailhot et al.
8,740,005 B1 6/2014 Holbrook et al.
8,789,714 B1 7/2014 Kruger et al.
8,801,326 B2 8/2014 Coppes et al.
8,857,641 B1 10/2014 Moore, Jr. et al.
9,016,979 B1 4/2015 Coppes et al.
9,045,873 B1 6/2015 Moore, Jr.
D737,927 S 9/2015 DiTullio
9,174,863 B2 11/2015 Potts
9,233,775 B1 1/2016 Holbrook et al.
9,255,394 B2 2/2016 Mailhot et al.
9,260,854 B1 2/2016 Moore, Jr. et al.
9,273,440 B1 3/2016 Moore, Jr. et al.
D753,262 S 4/2016 DiTullio
9,365,993 B1 6/2016 Moore, Jr. et al.
9,403,692 B2 8/2016 Potts
9,556,576 B2 1/2017 Mailhot et al.
9,637,907 B2 5/2017 Mailhot et al.
9,650,271 B2 5/2017 Potts
9,656,892 B2 5/2017 Potts
9,670,660 B1 6/2017 Moore, Jr. et al.
D791,272 S 7/2017 DiTullio
D792,552 S 7/2017 DiTullio
9,752,312 B2 9/2017 Holbrook et al.
9,765,509 B1 9/2017 DiTullio
9,809,968 B1 11/2017 Holbrook et al.
9,840,040 B2 12/2017 Moore, Jr. et al.
9,850,647 B1 12/2017 Coppes et al.
9,850,648 B1 12/2017 DiTullio
D806,827 S 1/2018 Mailhot et al.
9,885,171 B2 2/2018 Mailhot et al.
9,889,986 B2 2/2018 Holbrook et al.
9,982,425 B2 5/2018 Vitarelli et al.
D820,384 S 6/2018 DiTullio
10,065,875 B2 9/2018 Potts
D832,393 S 10/2018 DiTullio et al.
10,179,989 B2 1/2019 DiTullio
D840,499 S 2/2019 DiTullio et al.
2006/0012166 A1 1/2006 Siferd et al.
2007/0077122 A1 4/2007 Birchler et al.
2007/0081860 A1 4/2007 Goddard et al.
2008/0187399 A1* 8/2008 Suazo ..... E02B 5/02 405/118
2010/0329788 A1 12/2010 Moore, Jr.
2010/0329789 A1* 12/2010 Coppes ..... E03F 1/003 405/49

(56) References Cited

U.S. PATENT DOCUMENTS

| | | | |
|---|---|---|---|
| 2011/0020065 | A1 | 1/2011 | Moore, Jr. et al. |
| 2011/0200391 | A1 | 8/2011 | Mailhot et al. |
| 2011/0293370 | A1 | 12/2011 | Moore, Jr. et al. |
| 2013/0075315 | A1 | 3/2013 | Potts |
| 2016/0084406 | A1 | 3/2016 | Potts et al. |
| 2016/0186423 | A1 | 6/2016 | Coppes et al. |
| 2016/0326033 | A1 | 11/2016 | Potts |
| 2017/0191251 | A1 | 7/2017 | Trude et al. |
| 2018/0044905 | A1 | 2/2018 | Potts et al. |
| 2018/0087258 | A1 | 3/2018 | Holbrook et al. |
| 2018/0238039 | A1 | 8/2018 | Vitarelli et al. |
| 2018/0319686 | A1 | 11/2018 | Potts et al. |

* cited by examiner

ASYMMETRIC LEACHING CHAMBER FOR ONSITE WASTEWATER MANAGEMENT SYSTEM

CROSS REFERENCE TO RELATED APPLICATIONS

This application is a nonprovisional patent application which claims the benefit of U.S. Provisional Application Ser. No. 63/223,230, filed on Jul. 19, 2021, entitled "Asymmetric Leaching Chamber For Onsite Wastewater Management System," and U.S. Provisional Application Ser. No. 63/310,771, filed on Feb. 16, 2022, entitled "Septic Chamber Snap Locking Coupling Joint," the contents of which are incorporated herein in their entirety by reference thereto.

FIELD OF INVENTION

The present invention relates generally to the art of wastewater management systems, and more particularly to the construction of an improved leaching chamber design having an asymmetrical corrugation configuration running transversely along the length of the chamber, where each transverse corrugation has a wide section on one side and a narrow section on the opposed side of the chamber.

BACKGROUND

The statements in this section merely provide background information related to the present disclosure and may not constitute prior art.

Decentralized on-site septic systems are used to sustainably manage and treat sanitary waste streams from residences, commercial, industrial, and communal sites. Onsite septic systems are comprised of a conveyance pipe connecting the house plumbing to one or two underground septic tanks which are then connected to a series of laterals comprised of pipes or chambers to allow for effluent treatment and dispersion into the soil. The purpose of the laterals is to provide maximum contact with surrounding soil to promote biological activity to breakdown and treat the effluent. While pipe systems perform reasonably well, open bottom chambers have proven more effective due to the significant increase in underground soil contact area which enables more treatment per unit of length of the system. Whether the laterals are comprised of pipe or chambers, they are commonly 20' to hundreds of feet long, requiring several chambers or pipe connected together.

To maximize chamber effectiveness, the bottom must be open and the sidewalls designed to promote maximum transfer of effluent through the walls without permitting soil infiltration. Further, these chambers must accommodate handling and installation forces as well as earth and vehicle loads such as AASHTO H-10 truckloads.

Traditionally, chambers are designed with corrugations running transverse and perpendicular to the length and chambers may include structural columns to support the traffic and earth loads. Typically, there are louver sections on the side of the chamber in the valleys and the peaks of the corrugations to maximize the soil contact area. Stiffeners are added lengthwise to increase the stiffness of the chamber for handling and installation.

The extensive louver sections located along the side of the chamber in the corrugation peaks and sometimes valleys result in reduced structural capacity and can require additional stiffening by way of structural columns. Columns and other structural reinforcements add weight, complicate stacking and handling as well as manufacturing.

While some recent advancements in the art and have met with reasonable success, additional problems have been presented. For instance, "continuous curve" cross-sectional shape chambers have been advocated, but such chambers present additional difficulties. Decreasing chamber span to maximize stiffness to weight ratio results in sharper crown pitch angles, thus making maneuverability for installers across the chamber crown more difficult and time consuming. Increasing chamber span, however, often requires the use of strengthening ribs or columns for support, which increase cost and weight. Still further, the transverse corrugations of such chambers are typically aligned perpendicular to the length of the chamber, thus limiting longitudinal stiffness of the chamber, i.e., "slinky" effect. Therefore, there is still a distinct need for improvement in the industry.

SUMMARY

One object of the present invention is to provide a leaching chamber which facilitates increased chamber span without requiring support columns. Another object is to increase the available footprint on the chamber crown without sacrificing load strength. Still another object of the present invention is to provide a chamber corrugation profile which increases longitudinal stiffness of the chamber. Still further, it is an object of the present invention to provide a chamber with sidewalls having an increased stiffness to weight ratio, while maximizing louver area for greater effluent to soil contact area. It is also an object to accomplish the forgoing with a chamber that provides a reduced cost per unit of leaching area.

In furtherance of the foregoing objectives, the present invention incorporates a novel approach for septic chambers, to offer a high degree of bottom and sidewall leaching area while not requiring columns and extra stiffening features. The chamber design includes asymmetric corrugations running transversely along the length of the chamber. Each transverse corrugation has a wide section on one side and a narrow section on the opposed side of the chamber. Consequently, the corrugation walls run at an angle to the longitudinal axis of the chamber, thus significantly increasing the longitudinal stiffness of the chamber.

The ratio of corrugation width from opposing sides of the chamber ranges from about 2:1 to 15:1. Considering the arch shape of the chamber, from an end view, the arch is asymmetric where the widest corrugation side of the chamber has a straight sidewall. The arch curves from the top of the straight sidewall to the narrow side of the corrugation at the opposing side of the chamber. The asymmetric arch is comprised of a multi radius curve from the top of the straight side to the opposing footer. The curved arch section and straight sidewall of each corrugation helps to significantly enhance the stiffness to weight ratio of the chamber, while maximizing louver area for greater effluent to soil contact.

The foregoing and additional features and advantages of the present invention will be more readily apparent from the following detailed description. It should be understood, however, that the description and specific examples herein are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
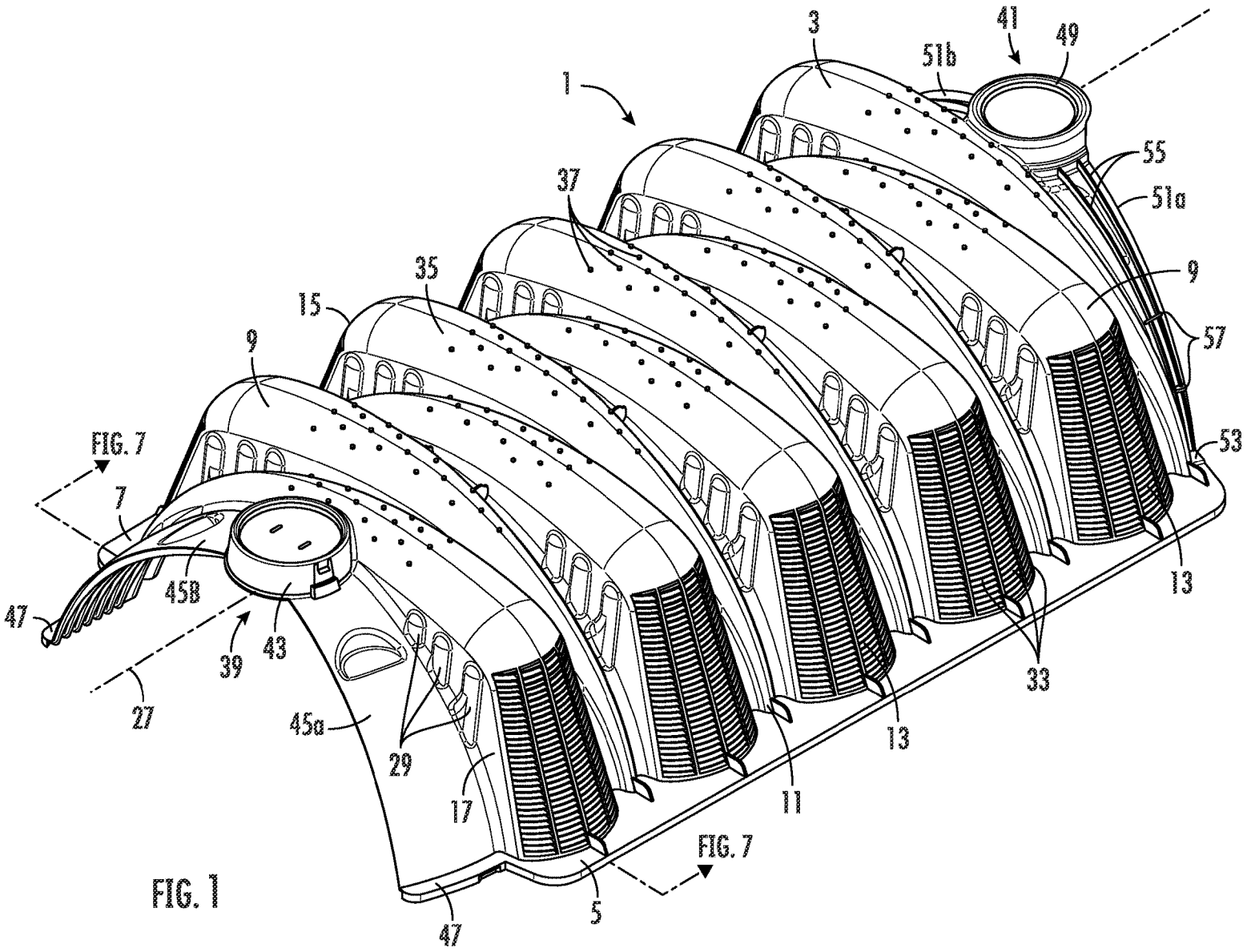
FIG. 1 is a perspective view of my improved asymmetric chamber design incorporating the principles of my invention, viewed from one end thereof.

The following description is merely exemplary in nature and is not intended to limit the present disclosure, application, or uses. It should be understood that throughout the drawings, corresponding reference numerals indicate like or corresponding parts and features.

Figure 2:
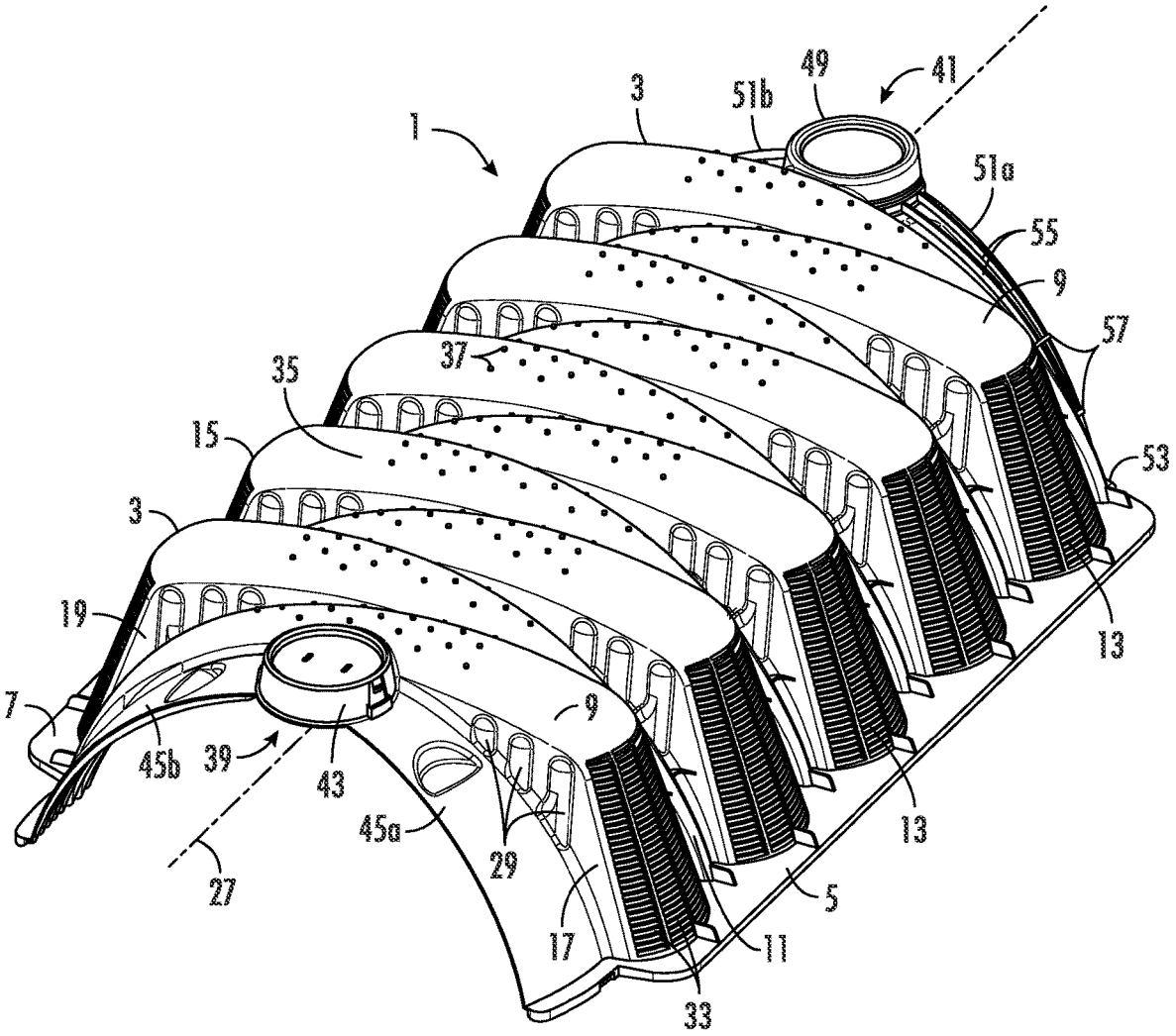
FIG. 2 is another perspective view of the asymmetric chamber design shown in FIG. 1, viewed from a slightly different angle.
Figure 3:
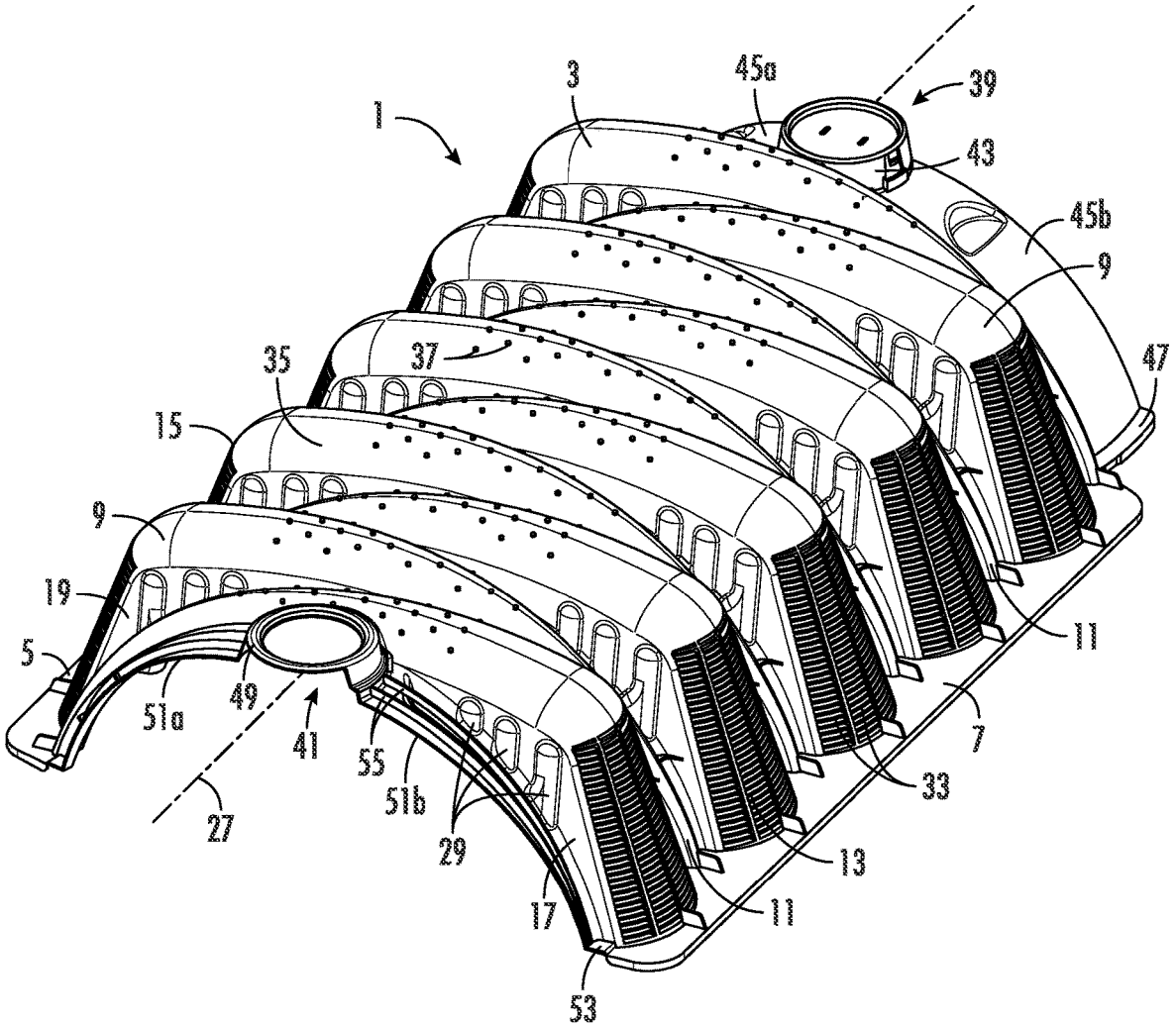
FIG. 3 is a perspective view of the asymmetric chamber design shown in FIG. 1, viewed from the opposite end thereof.

With reference now to FIGS. 1-3 of the drawings, an improved leaching chamber 1 having an asymmetrical corrugation profile design constructed in accordance with my invention is disclosed. As shown, the main body of chamber 1 includes a series of asymmetric corrugations 3 running along the length thereof. Each corrugation 3 extends transversely relative to a longitudinal axis 27 of chamber 1 from the base 5 on one side of the chamber 1 to the base 7 on the other side of the chamber 1. Each transverse corrugation 3 has a wide section 9 on one side of chamber 1 and a narrow section 11 on the opposite side of the chamber 1, the orientation of which alternates along the length of chamber 1.

Figure 4:
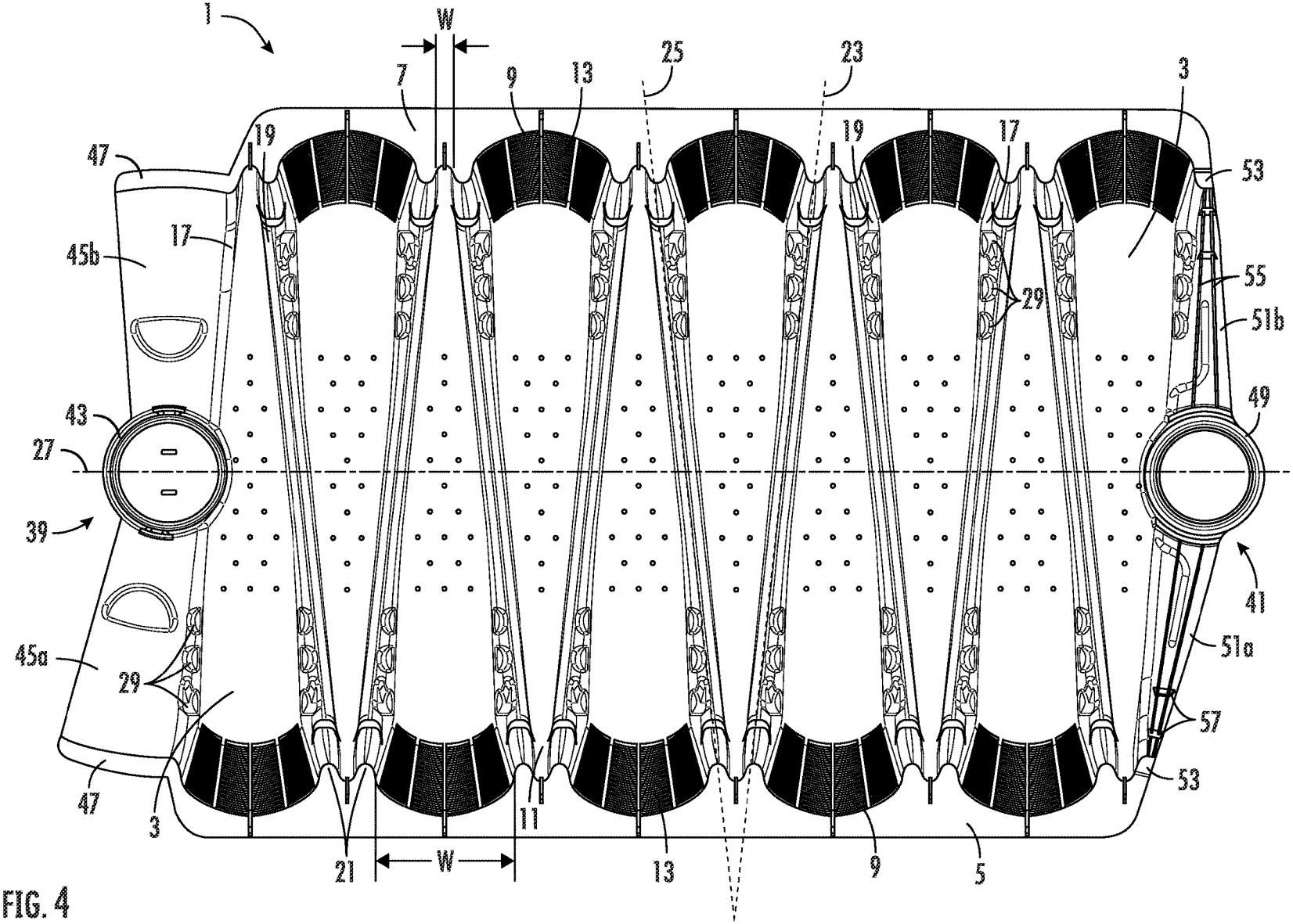
FIG. 4 is a top plan view of my improved asymmetric chamber design shown in FIGS. 1-3.
Figure 7:
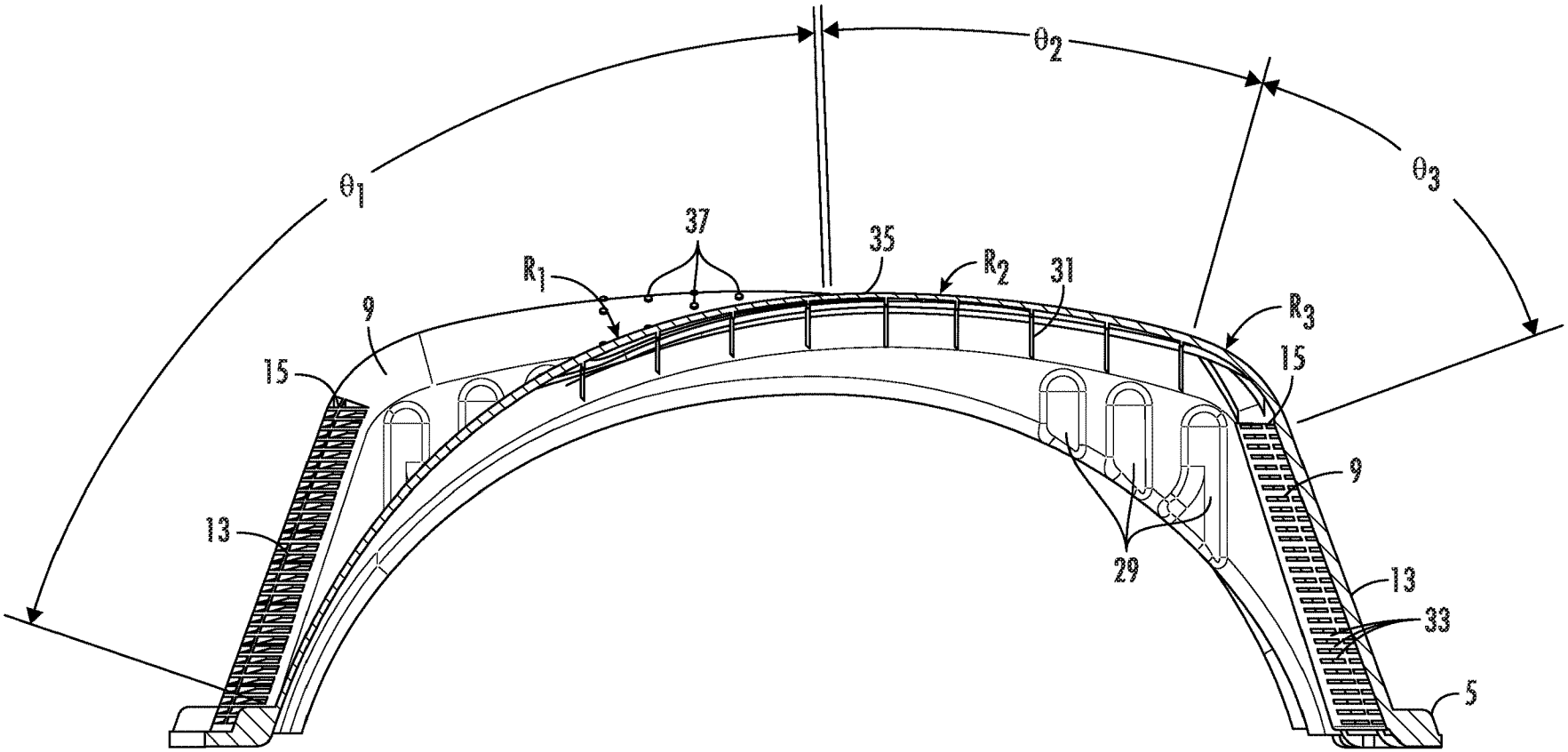
FIG. 7 is a vertical transverse cross-sectional view of my improved asymmetric chamber design shown in FIG. 1, taken along lines 7-7 therein.

With reference to FIG. 7, it can be seen from a cross section of chamber 1 (taken along line 7-7 of FIG. 1), the transverse arch of each corrugation 3 is asymmetric relative to the longitudinal axis 27 of the chamber 1. As shown, the widest section 9 of each corrugation 3 has a substantially straight sidewall section 13. The arch of each corrugation 3 curves continuously from a point adjacent the top 15 of the straight sidewall 13 on one side of the chamber 1 across and downward to the narrow section 11 of the corrugation located adjacent the base at the opposing side of the chamber 1. Each successive corrugation 3 alternates orientation such that it curves transversely across and downward in the opposite direction as the preceding corrugation 3 along the length of the chamber 1. As best seen in FIG. 4, the ratio of corrugation width "W" of each corrugation 3 from the base of opposing sides (9, 11) thereof may range from approximately 2:1 to 15:1 (i.e., measured at the tangent point between the valley radius and the base of the corrugation wall located at the base (5, 7) of the chamber (1).

As shown, the asymmetric arch of each corrugation 3 is comprised of a multi radius curve extending from a point adjacent the top 15 of the straight sidewall 13 to the opposing base of the chamber 1. In one embodiment shown in FIG. 7, the continuous multi radius arch curve is shown as being composed of multiple arch sections having angles $\theta_1$, $\theta_2$, and $\theta_3$ with corresponding radiuses $R_1$, $R_2$, and $R_3$. By way of example only, in one embodiment, it is contemplated that section $\theta_1$ of the arch may have a radius of 1.61 feet extending over approximately 70 degrees; $\theta_2$ may have a radius of 3.25 feet extending over approximately 17 degrees; and $\theta_3$ may have a radius of 0.38 feet extending over approximately 55 degrees. Of course, other possibilities and/or combinations of radiused sections of the arch are possible and contemplated herein, including a single continuous arch curve, without departing from the invention herein.

Figure 5:
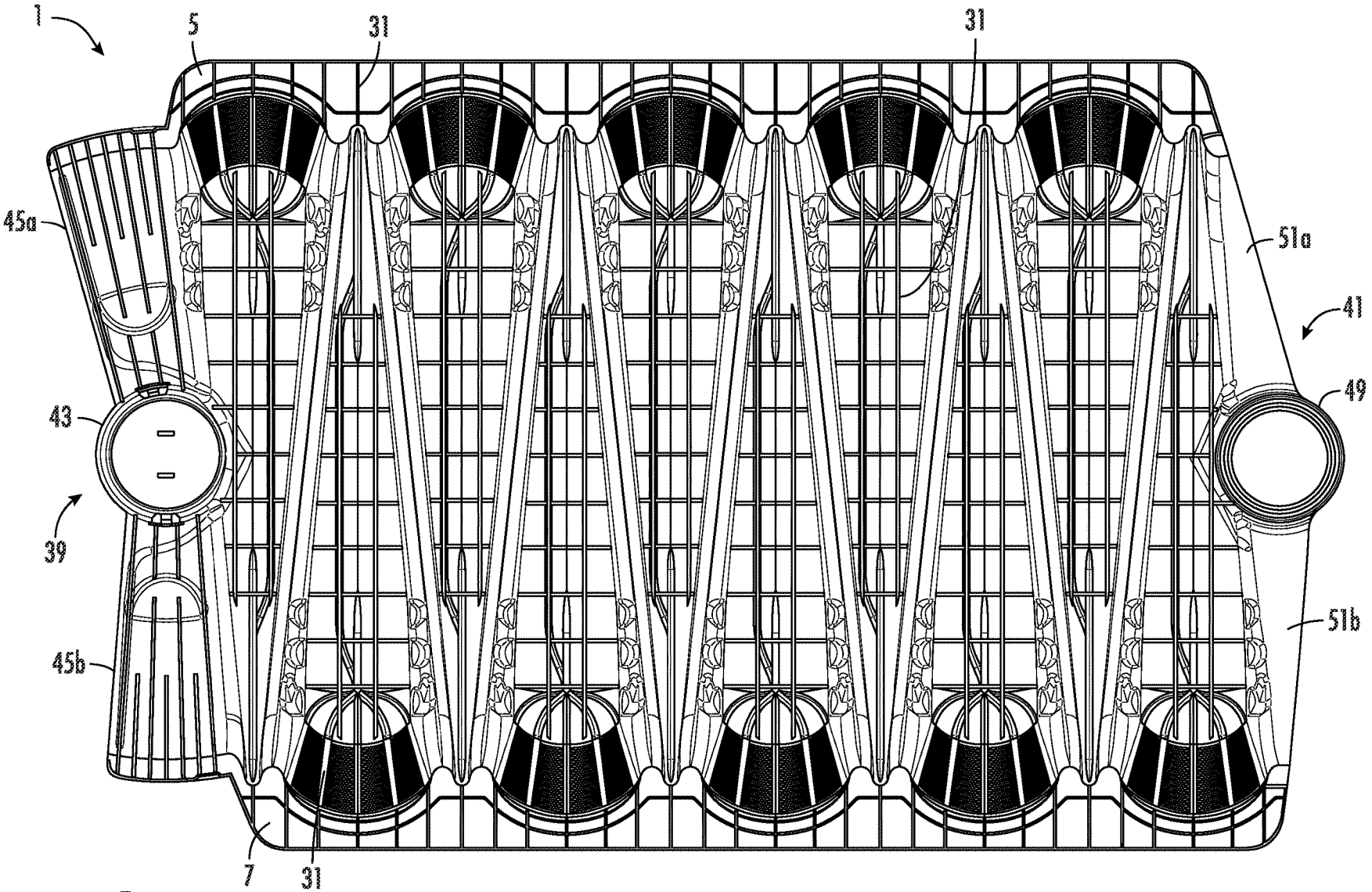
FIG. 5 is a bottom plan view of my improved asymmetric chamber design shown in FIGS. 1-3.

As best shown in FIGS. 4 and 5, because each corrugation 3 is constructed with a wide section 9 and a narrow section 11, the corrugation walls 17 and 19 which define the crown portion of each corrugation 3, and the valley portions 21 therebetween, extend along transverse axes 23 and 25 that are angularly offset from perpendicular relative to the longitudinal axis 27 of chamber 1. The offset axes and non-perpendicular corrugation walls 17 and 19 created by this asymmetric configuration act to substantially reduce the potential for any transverse perpendicular bending moment of the chamber 1, thus increasing the longitudinal axial strength of the chamber. This is a significant improvement over prior art chambers, the corrugations of which generally run parallel to one another in transverse perpendicular orientation relative to the longitudinal axis of the chamber, thus limiting the longitudinal strength of the chamber.

As noted previously, the wide section 9 of each corrugation 3 of chamber 1 is constructed with substantially straight, planar sidewalls 13. Incorporating the wide planar sidewalls 13 effectively increases the vertical load capability and stiffness to weight ratio of the chamber 1. Similarly, the arched formation of each corrugation 3 from the top 15 of the wide section 9 to the narrow section 11 at the base of the opposing side of chamber 1 provides further superior load distribution capability. Together, these features allow chamber 1 to be expanded in width without jeopardizing vertical load strength or requiring added supporting ribs or columns. Furthermore, as seen best in FIGS. 4 and 5, the narrow valley portions 21 extending between each corrugation 3, in effect, create a series of internal strengthening members which help to further enhance the stiffness to weight ratio of the chamber 1.

In one contemplated embodiment, a series of one or more vertically extending sub-corrugations 29 may be formed on the opposing corrugation walls 17 and 19 of each corrugation 3, preferably adjacent the wider sidewall section 9 thereof. These sub-corrugations 29 extend vertically at least part way up the corrugation walls 17 and 19 from within the valley portions 21 between of each corrugation 3. Sub-corrugations 29 serve to provide additional vertical load capability and strength to each corrugation 3, particularly in the area of the wider sidewall section 9.

With reference being had to FIG. 5, it is seen that an additional latticework of supporting rib structures 31 may also be formed on the underside of the chamber 1, including the underside surface of the corrugations 3, the sidewalls 9, and the bases 5 and 7 which extend outward from the chamber 1. It is worth noting that the ribs 31 are incorporated primarily to accommodate localized strength requirements rather than improving the strength of the overall arch, i.e., for preventing localized buckling rather than contribution of overall arch stiffness. This is especially important for lower quality installation conditions. Without the present design features of chamber 1, the ribs 31 would actually need to be much more substantial. Nevertheless, such an added latticework of supporting ribs 31 can function to provide additional overall strength and support to the chamber 1 as well.

Figure 6:
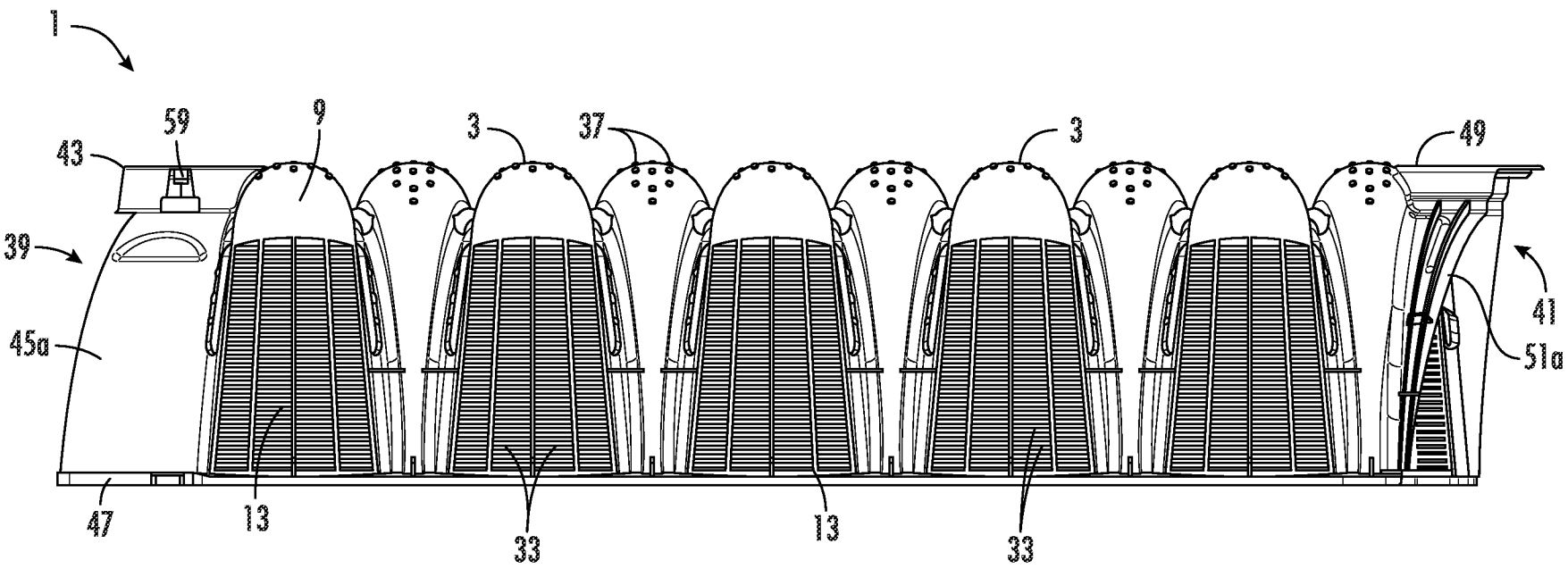
FIG. 6 is a right-side elevation view of my improved asymmetric chamber design shown in FIGS. 1-3.

As shown throughout the drawings, at least a portion of the large planar sidewalls 13 of each corrugation 3 include a plurality of vertically spaced elongated horizontal louvered slots 33 which extend from the interior of the chamber 1 through to the exterior. As seen best in FIG. 6, with this asymmetric corrugation design, the spacing between each adjacent large corrugation sidewall section 9, and the slotted sidewall sections 13 thereof, is minimized. This effectively maximizes the area for effluent transfer through the chamber sidewalls and into the surrounding soil.

As seen best in FIGS. 1-4, on at least a portion of the top surface 35 of each corrugation 3, a plurality of optional traction nubs 37 may be incorporated to help provide better footing and traction for installers and others during installation of the chambers 1. Such traction nubs 37 may comprise numerous small pyramids or cone-like shaped upstanding projections with upwardly facing apexes intended to engage the footwear of installers and others who traverse across the chambers 1 during installation. Of course, other configurations and differently shaped traction nub features are conceivable which would help to enhance traction atop such chambers 1 without departing form the invention herein.

As further shown in the drawings, chamber 1 is constructed with a first integral end connector 39 on one end of the chamber 1 and a second integral end connector 41 formed on the opposite end of the chamber 1. Each end connector 39 and 41 has an opening communicating with the interior of the main body of the chamber 1. The first end connector 39 includes a circular riser section 43 at its top and a pair of sidewall sections 45*a* and 45*b* extending downward therefrom to a base 47 which is substantially coplanar with the chamber side base members 5 and 7. The second end connector 41 is similarly comprised of an upper circular riser section 49 with descending sidewall sections 51*a* and 51*b* which extend downward to a base 53 that is also substantially coplanar with the chamber side base members 5 and 7.

End connectors 39 and 41 are designed to compliantly mate with one another to provide angular movement of one chamber 1 relative to another chamber 1 of like configuration in a horizontal plane. With reference to the embodiment shown in FIGS. 1-7, the second end connector 41 is designed in such manner as to overlap the first end connector 39. The circular riser section 49 of end connector 41 is configured to compliantly seat over the top of circular riser section 43 of end connector 39, thereby facilitating pivotal movement between adjoining chambers 1 of like construction. Similarly, sidewall segments 51*a*, 51*b* of the second end connector 41 are configured to overlay sidewall segments 45*a*, 45*b* of the first end connector 39 in such manner as to facilitate close-fitting overlapping angular movement therebetween.

As seen best in FIGS. 1 and 4, the outer surface of each overlapping sidewall section 51*a*, 51*b* of the second end connector 41 may also be configured to include one or more elongated strengthening ribs 55 extending vertically between the circular riser 49 and base section 53 thereof. Also, one or more additional shorter horizontal extending strengthening ribs 57 may traverse ribs 55 for added support and strength. These strengthening ribs 55, 57 help to add further support and vertical load strength to the mating end connector sections 39 and 41.

Figure 8:
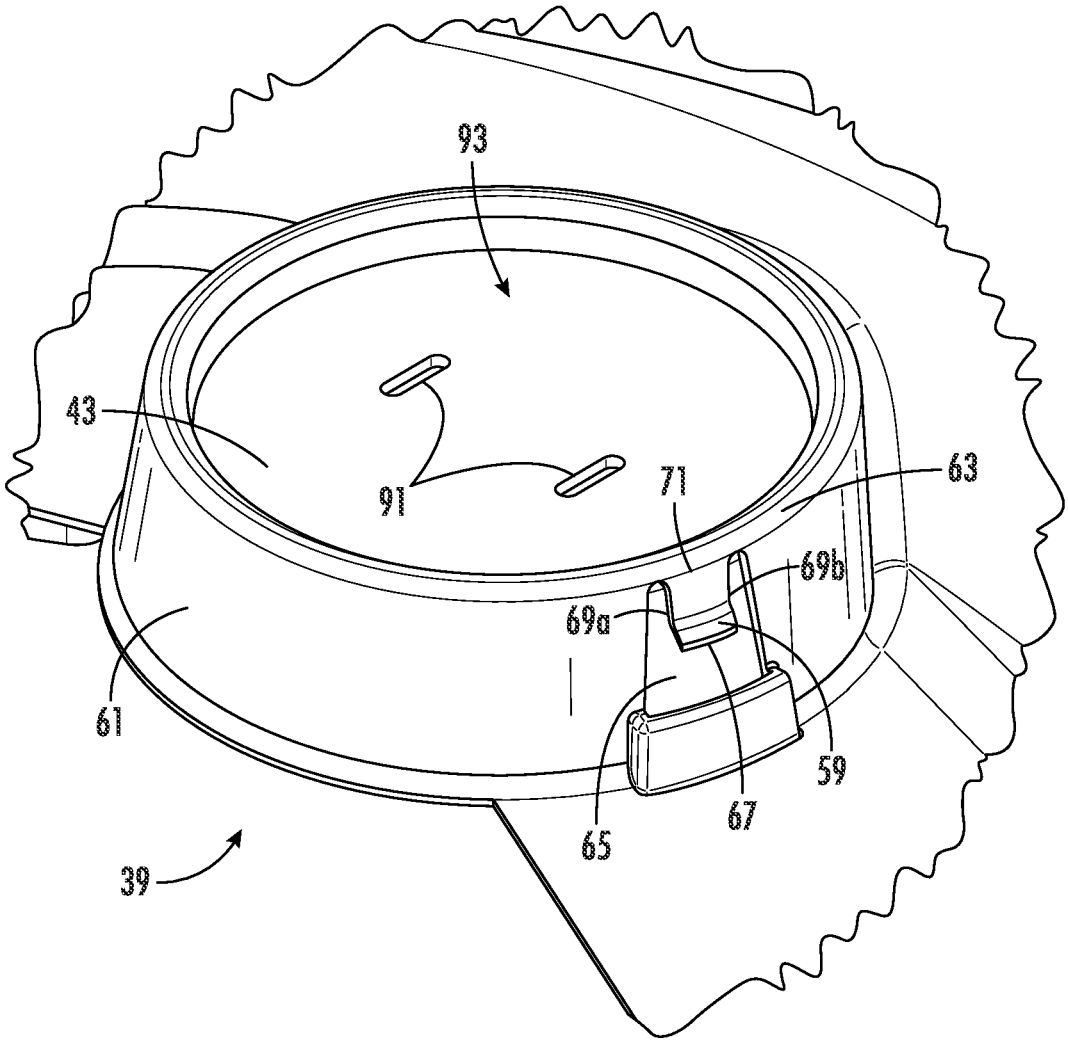
FIG. 8 is a blown-up perspective detail view of the circular riser section of one chamber end connector, showing the construction of a snap-lock latch element formed therein.
Figure 9:
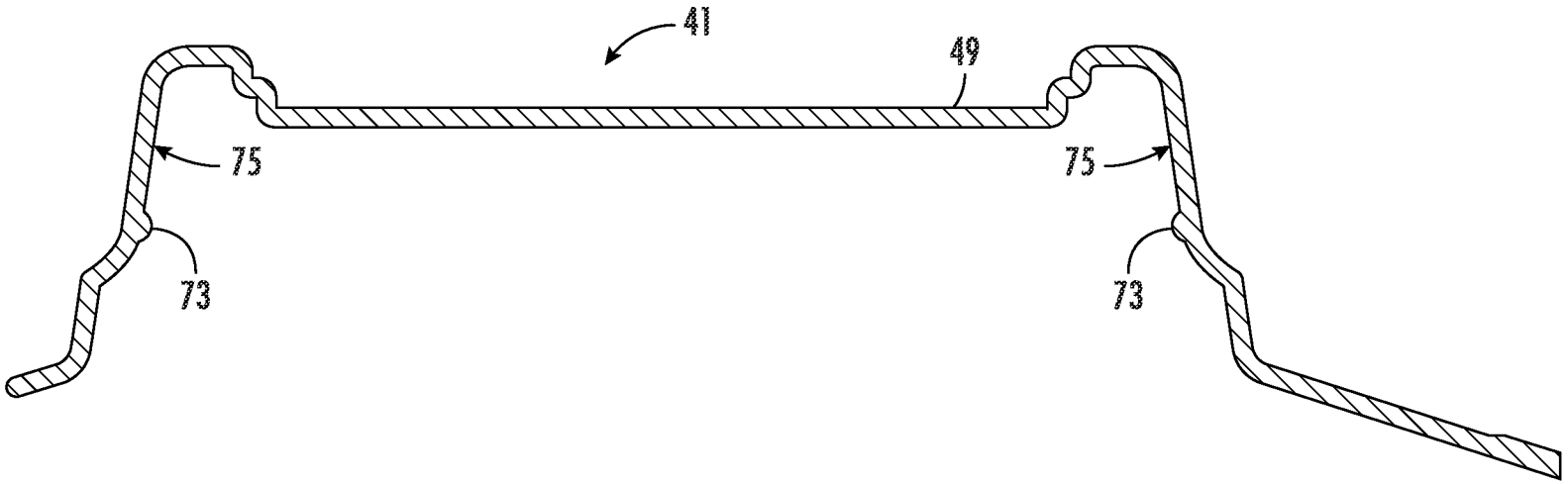
FIG. 9 is a blown-up cross-sectional view of the circular riser section of the opposite chamber end connector as shown in FIG. 8, showing the formation of the snap-lock retention pocket formed therein.
Figure 10:
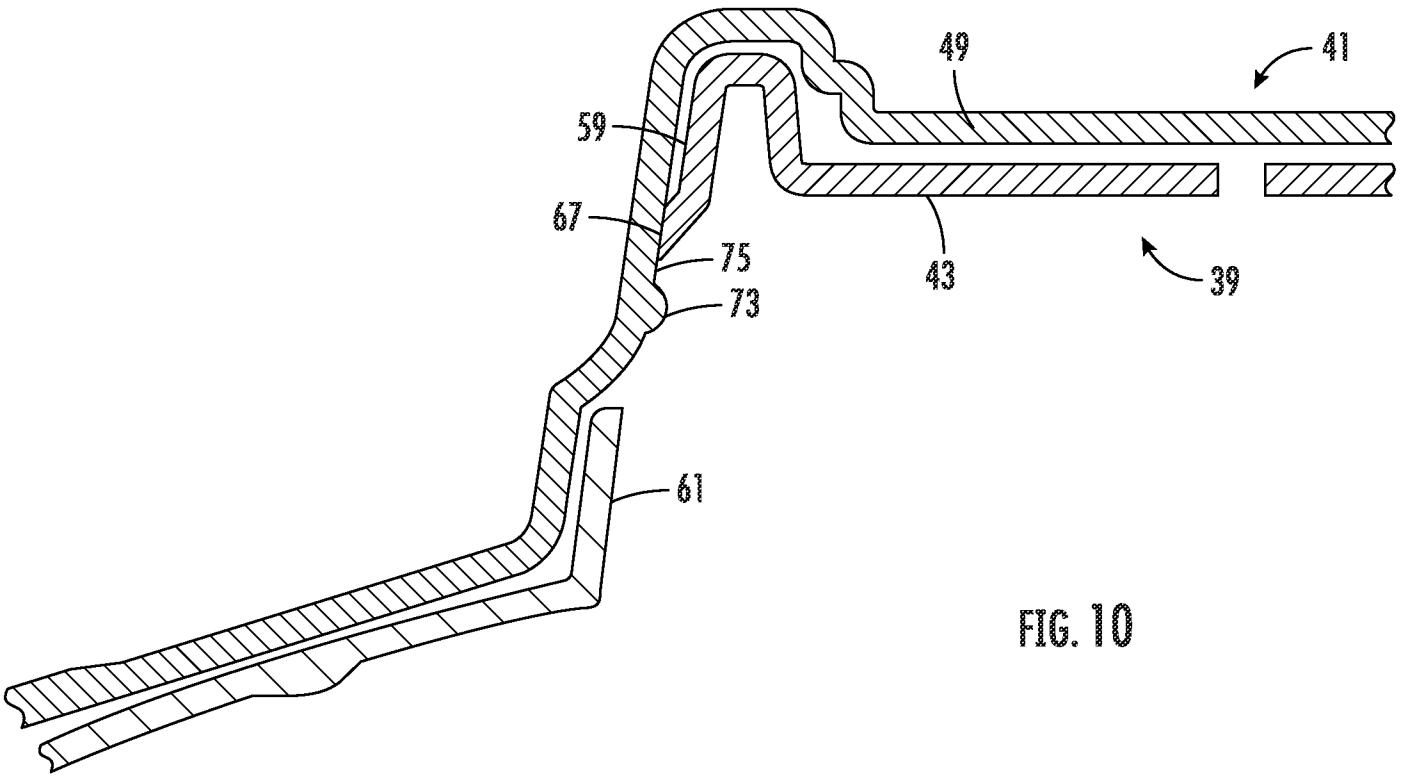
FIG. 10 is a blown-up cross-sectional view showing a portion of the end connectors of FIG. 8 and FIG. 9 interconnected in locking relation.

The angularly adjustable and inter-lockable connection between the first and second end connectors 39 and 41 is best illustrated in FIGS. 8, 9 and 10. As seen, a positive locking engagement can be achieved by incorporating a built-in snap locking feature between the end connectors. As shown in FIG. 8, at least one flexible snap locking member 59 may be formed in the tapered sidewall 61 of the circular riser section 43 of the underlying first end connector 39. Each snap locking member 59 is designed to extend downward from a top perimeter portion 63 of the circular riser section 43. This locking member 59 is provided with a relief in the form of an opening 65 extending around its lower end 67 and along each of its sides 69*a* and 69*b*, thus creating a cantilever along its top supporting edge 71. This imparts radial flexibility to the locking member 59 relative to the circular riser section 43 to facilitate joinder with an overlapping coupling section 41 of another chamber 1.

As seen in FIG. 8, the lower end portion 67 of the snap locking member 59 flares radially outward relative to the tapered sidewall 61 of the underlying first end connector 39. As seen in FIG. 9, a radially inward protruding peripheral shoulder 73 on the circular riser section 49 of the second end connector 41 defines a snap-lock retention pocket 75. As seen in FIG. 10, this retention pocket 75 is adapted to receive the lower flared end portion 67 of the snap locking member 59 when two chambers 1 are joined together, i.e., the second end connector 41 is seated on top of the first end connector 39 in overlapping relation.

As best seen in FIGS. 9 and 10, shoulder 73 is positioned on the inner circumference of circular riser section 49 to correspond with the positioning of an associated locking member 59 on the circular riser section 39 of an adjoining chamber 1. Shoulder 73 extends at least partially around the inner circumferential surface of the circular riser section 49 and is spaced downward from the top thereof, thus defining the retention pocket 75 adjacent a top portion of the second end connector 41.

Upon angular adjustment of two adjoining chambers 1, the flared end 67 of the flexible snap locking member 59 of end connector 39 will be permitted to slide along the inward protruding shoulder 73 of the overlapping end connector 41, thus allowing the snap locking member 59, and its associated chamber 1, to rotate about the center of the mating end connectors 39 and 41. In this manner, the joined chambers 1 are allowed to freely pivot to a degree left or right relative to one another (typically 3 to 10 degrees left and right).

Figure 11:
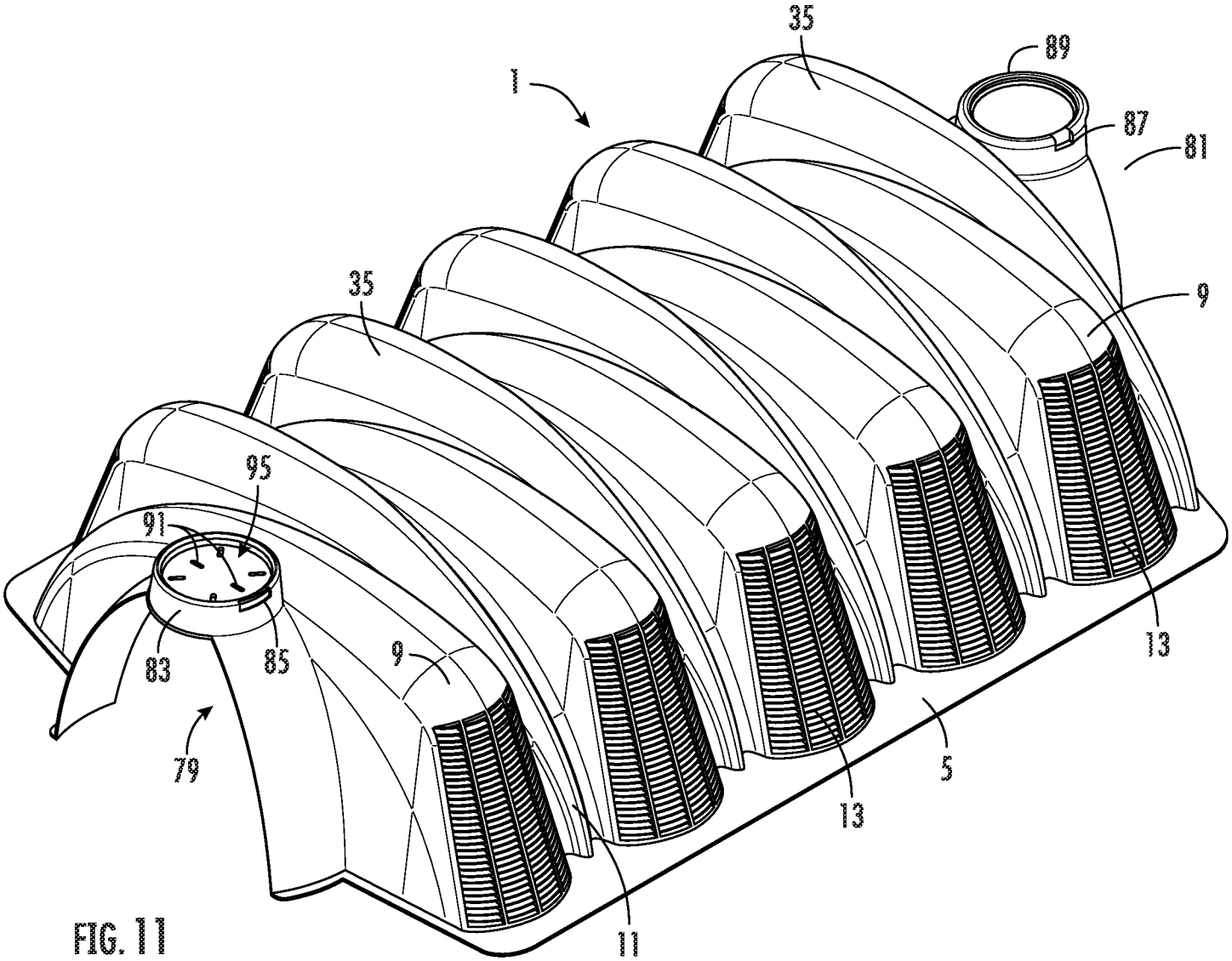
FIG. 11 is a perspective view of an asymmetric chamber design incorporating the principles of my invention, showing an alternative snap-lock end connector design.

Other potential end connector configurations capable of permitting angular adjustment are also conceivable. For instance, an alternative embodiment is shown in FIG. 11. In this embodiment, end connectors 79 and 81 are formed with a flexible lock and catch latching system which permits angular adjustment and prevents vertical movement of adjoining chambers 1 when secured together in the field. As shown, an upper edge portion of the riser section 83 on a first end connector 79 is formed with an elongated peripheral opening 85 which functions as a catch. The overlaying second end connector 81 is formed with a corresponding flexible latch member 87 on riser section 89. Latch member 87 is positioned to align with catch opening 85 and engage the same in locking relation when two like chambers 1 are fitted together end-to-end, thereby restricting vertical movement between the adjoining end connectors. The latch member 87 is permitted to slide laterally within the elongated peripheral slot 85 so as not to obstruct horizontal angular movement of one chamber 1 relative to another when latched together. Latch member 87 is also constructed with a small outward extending flange which may be gripped to release latch member 87 from locking relation with catch 85 in the event it is necessary or desired for any reason to disconnect a pair of adjoined chambers 1.

As further shown in FIGS. 8 and 11, with either end connector embodiment, the riser section (43, 83) of the underlying first end connector (39, 79) may also be formed with openings 91 in an upper surface thereof through which a conventional dosing pipe hanging means, such as a plastic cable tie (not shown), may be received to secure a dosing pipe (not shown) to the upper interior portion of chamber 1. The tie may be routed down through one opening 91, around the dosing pipe, and back through another opening 91 for connection on top of the riser (43, 83). The locking head of the cable tie will seat within the hollow (93, 95) formed in the top of the riser section (43, 83) so as not to interfere with rotational movement between joined end connectors.

The foregoing asymmetric chamber design with large slotted planar sidewall sections and arched corrugations allows for chambers having a greater width-span, larger crown area, and overall greater underground soil contact area, thus enabling more treatment of effluent per unit length of the system. Further, such design increases the available footprint on the chamber crown without sacrificing load strength and provides a chamber corrugation profile which significantly increases the longitudinal stiffness of the chamber. Still further, it provides a chamber with sidewalls having an increased stiffness to weight ratio and maximizes the louver slot area for greater effluent to soil contact area. With the added benefit of angularly adjustable interlocking end connectors and broad studded crown surfaces offering enhanced traction, maximum flexibility and ease of use in the field is obtained.

The disclosure herein is intended to be merely exemplary in nature and, thus, variations that do not depart from the gist of the disclosure are intended to be within the scope of the disclosure. Such variations are not to be regarded as a departure from the spirit and scope of the disclosure, which comprises the matter shown and described herein, and set forth in the appended claims.

The invention claimed is:

1. A leaching chamber for use with an onsite wastewater management system, comprising:

(a) a chamber body having an open bottom and a generally arch-shaped cross section extending between opposite side bases thereof, said chamber body including a plurality of corrugations extending transversely between said opposite side bases;

(b) said plurality of corrugations being formed by a series of spaced crown portions and valley portions disposed therebetween, each of said crown portions having a substantially straight sidewall section extending upwardly from one of said side bases to a top portion thereof, and a continuously curved section extending from said top portion across and downward to said side base on said opposite side of said chamber body; and (c) wherein the shape of each of said plurality of corrugations is asymmetrical about a central axis of said chamber body extending perpendicular to said chamber body cross section.

2. The leaching chamber set forth in claim 1, wherein said substantially straight sidewall section and said curved section of each of said crown portions is reversed in orientation relative to that of an adjacent said crown portion.

3. The leaching chamber set forth in claim 1, wherein said substantially straight sidewall section of each of said crown portions is substantially wider adjacent said side base from which it extends than the width of said continuously curved section adjacent said opposite side base.

4. The leaching chamber set forth in claim 1, wherein said substantially straight sidewall section of each of said crown portions includes a plurality of horizontal slots extending therethrough from an exterior of said chamber body to an interior thereof to allow wastewater to flow through said chamber body.

5. The leaching chamber set forth in claim 1, wherein said valley portions of each of said plurality of corrugations extend at an angle relative to said central axis of said chamber body.

6. The leaching chamber set forth in claim 1, wherein said continuously curved section of each of said plurality of corrugations is formed of a multi-radius curve.

7. The leaching chamber set forth in claim 1, wherein said crown portion of each of said plurality of corrugations tapers in width from a widest point adjacent a bottom of said substantially straight sidewall section to a narrowest point adjacent a bottom of said continuously curved section.

8. The leaching chamber set forth in claim 7, wherein a ratio of taper from said widest point of said crown portion to said narrowest point is in an approximate range of 2:1 to 15:1.

9. The leaching chamber set forth in claim 1, wherein said crown portion of each of said corrugations includes a plurality of traction nubs formed on an outer surface thereof.

10. The leaching chamber set forth in claim 1, wherein a corrugation wall section connecting said crown portion to an adjacent said valley portion of each of said plurality of corrugations includes at least one vertically extending sub-corrugation positioned adjacent to said substantially straight sidewall section thereof.

11. A leaching chamber for use with an onsite wastewater management system, comprising:

(a) an elongated generally arch-shaped chamber body having a plurality of corrugations with successive alternating crown and valley portions positioned along the length thereof, said corrugations extending transversely relative to a longitudinal axis of said chamber body between a base on a first side of said chamber body and a base on an opposite second side of said chamber body;

(b) a first corrugation of said plurality of corrugations having a substantially straight sidewall section extending upwardly from said base on said first side of said chamber body to a top portion thereof, and a continuously curved section extending from said top portion across and downward to said base on said opposite second side of said chamber body;

(c) a second corrugation of said plurality of corrugations adjacent to said first corrugation having a substantially straight sidewall section extending upwardly from said base on said second side of said chamber body to a top portion thereof, and a continuously curved section extending from said top portion across and downward to said base on said first side of said chamber body; and (d) said substantially straight sidewall section of said first corrugation and said second corrugation including a plurality of substantially horizontal slots extending therethrough from an exterior of said chamber body to an interior thereof to allow wastewater to flow through said chamber body.

12. The leaching chamber set forth in claim 11, wherein said substantially straight sidewall section of said first corrugation and said second corrugation is substantially wider in the direction of said longitudinal axis of said chamber body than said curved section is at said base to which it extends.

13. The leaching chamber set forth in claim 11, wherein said curved section of said first corrugation and said second corrugation taper in width from said top portion thereof to said base to which it extends.

14. The leaching chamber set forth in claim 11, wherein said curved section of said first corrugation and said second corrugation is formed of a multi-radius curve.

15. The leaching chamber set forth in claim 11, wherein said curved section of said first corrugation and said second corrugation include a plurality of traction nubs formed on an outer surface thereof.

16. The leaching chamber set forth in claim 11, wherein a corrugation wall section connecting said crown portion to an adjacent said valley portion of each of said plurality of corrugations includes at least one vertically extending sub-corrugation positioned adjacent said substantially straight sidewall section thereof.

17. The leaching chamber set forth in claim 11, wherein said chamber body includes a first end coupling section and a second end coupling section, and said first end coupling section is constructed to mate with and be angularly adjustable relative to said second end coupling section of a chamber of like construction.

18. A leaching chamber for use with an onsite wastewater management system, comprising:

(a) an elongated chamber body having an open bottom and a generally arch-shaped cross section extending between opposite side bases thereof, said chamber body including a plurality of corrugations extending transversely between said opposite side bases;

(b) each of said corrugations having opposing wall structures which form an asymmetrically shaped crown portion with an enlarged straight sidewall section extending upwardly from one of said side bases to a top portion thereof, and a multi-radiused continuous curved section extending from said top portion across and downward to said opposite side base;

(c) said curved section of each of said corrugations tapering in width from a point adjacent said top portion of said corrugation to a point adjacent said opposite side base to which it extends;

(d) said straight sidewall section and said curved section of each of said corrugations being reversed in orientation relative to that of said corrugation immediately adjacent thereto;

(e) said opposing wall structures of each of said corrugations including a plurality of vertically extending sub-corrugations positioned adjacent said straight sidewall section thereof; and (f) said straight sidewall section of each of said corrugations including a plurality of horizontal slots extending therethrough from an exterior of said chamber body to an interior thereof to allow wastewater to flow through said chamber body.

19. The leaching chamber set forth in claim 18, wherein a ratio of taper from a widest point of said crown portion of each of said corrugations to a narrowest point thereof is in an approximate range of 2:1 to 15:1.

20. The leaching chamber set forth in claim 18, wherein said chamber body includes a first end coupling section and a second end coupling section, and said first end coupling section is constructed to mate with and be angularly adjustable relative to said second end coupling section of a chamber of like construction.

* * * * *